United States Patent [19]

Sakakura et al.

[11] Patent Number: 4,985,731

[45] Date of Patent: Jan. 15, 1991

[54] IMAGE-FORMING APPARATUS

[75] Inventors: Shigeki Sakakura, Tama; Akihiro Komuro, Komae, both of Japan

[73] Assignee: Fujitsu Limited, Kawasaki, Japan

[21] Appl. No.: 356,364

[22] Filed: May 24, 1989

[30] Foreign Application Priority Data

May 25, 1988 [JP] Japan ..... 63-129364
May 26, 1988 [JP] Japan ..... 63-129025

[51] Int. Cl.[5] ..... G03G 15/00
[52] U.S. Cl. ..... 355/210; 355/200
[58] Field of Search ..... 355/200, 210, 308, 309

[56] References Cited

U.S. PATENT DOCUMENTS

| | | | |
|---|---|---|---|
| 4,444,486 | 4/1984 | Monkelbaan . | |
| 4,575,221 | 3/1986 | Onoda et al. | 355/200 |
| 4,588,280 | 5/1986 | Ogawa et al. | 355/200 |
| 4,609,276 | 9/1986 | Mitzutani | 355/210 |
| 4,702,587 | 10/1987 | Miyoshi | 355/200 |
| 4,803,510 | 2/1989 | Maeda | 355/210 |

FOREIGN PATENT DOCUMENTS

| | | | |
|---|---|---|---|
| 62-151871 | 7/1987 | Japan . | |
| 62-160467 | 7/1987 | Japan . | |
| 62-194261 | 8/1987 | Japan . | |
| 62-286067 | 12/1987 | Japan . | |
| 63-8653 | 1/1988 | Japan | 355/210 |

*Primary Examiner*—R. L. Moses
*Attorney, Agent, or Firm*—Staas & Halsey

[57] ABSTRACT

In an electrographic printer which comprises a photoconductive drum (5), a precharger (7), an LED array (11), a developer (8), a cleaner (9), a transfer-charger (3) and a fuser unit (4), in which the photoconductiver drum (5), the precharger (3), the developer (8) and the cleaner are built-in in a casing to form a process cartridge (2), a housing (1) of the printer is a clam-shell type having of a lower frame (1*a*) and an upper frame (1*b*) hinged to the lower frame at the rear end thereof so that an opening is formed between both frames (1*a*, 1*b*) when the upper frame (1*b*) is separated from the lower frame (1*a*), through which opening the process cartridge (2) is inserted into and removed from the housinhg (1).

17 Claims, 18 Drawing Sheets

(PROCESS CARTRIDGE REMOVED)

IMAGE-FORMING APPARATUS

BACKGROUND OF THE INVENTION

1. Field of the Invention

The present invention relates to an image-forming apparatus, such as an electrographic printer or a copying machine, in which an electrostatic image is formed and then reproduced as a toner image. More particularly, it relates to such an apparatus having a clam-shell type frame structure by which a process cartridge can be easily inserted and removed and a paper jam can be quickly cleared.

2. Description of the Related Arts

FIG. 1 is a schematic side view of an electrographic printer, wherein a process cartridge 2, a transfer-charger 3, and a fuser unit 4 are accommodated in a housing 1. The process cartridge 2 consists of a photoconductive drum 5 around which a developer unit 8, a precharger 7, and a cleaner 9 are arranged. All of these elements are built-in to a case to form a cartridge. A motor M is provided in the housing 1 to drive the photoconductive drum 5, the fuser unit 4, and a plurality of rollers 6*a*, 6*b* for moving a cut sheet 25 through the printer.

In the printing operation, cut sheets 25 are fed one by one from a hopper 10*a* or 10*b*, transported into an area between the transfer-charger 3 and the photoconductive drum 5, moved past the fuser unit 4, and finally, discharged to a stacker 12. More specifically, the precharger 7, an LED-array 11, the developer unit 8, the transfer-charger 3, and the cleaner 9 are sequentially arranged around the photoconductive drum 5. Accordingly, during a counter-clockwise rotation of the drum 5, the periphery thereof is uniformly charged by the precharger 7, an electrostatic latent image is then formed on the drum periphery by the LED-array 11 in accordance with input information, the latent image is reproduced as a toner image by the developer unit 8, the toner image is transferred to the surface of the cut sheet 25 by the transfer-charger 3 and fixed thereon by the fuser unit 4. Finally, the cut sheet 25 is discharged as a hard copy to the stacker 12.

As the printing operation is repeated, a powdery toner stored in the developer unit 8 is gradually consumed. When the toner is exhausted, the process cartridge 2 is replaced as a whole by a new cartridge. In the conventional printer, this replacement is carried out, as shown in FIG. 2, by laterally withdrawing the exhausted cartridge in the same direction as the axis of the photoconductive drum through a window 18 formed in the side wall of the housing 1, and inserting a fresh cartridge into the housing 1 in the reverse order, as disclosed in Japanese Examined Pat. Publication Nos. 58-54392 and 61-48152.

The structure of the housing 1 of the above printer, however, is weakened by the provision of the window 18, and this problem becomes more serious if the printer is small in size. In addition, space must be provided outside the side wall of the apparatus, to enable the lateral withdrawal and insertion of the process cartridge 2.

SUMMARY OF THE INVENTION

Accordingly, an object of the present invention is to eliminate the above drawbacks of the conventional image-forming apparatus.

Another object of the present invention is to provide a printer housing having good structural rigidity, wherein the replacement of a process cartridge is easily carried out.

A further object of the present invention is to provide a printer structure by which a paper jam is easily and quickly cleared.

These and other objects of the present invention are realized by an image-forming apparatus which includes an image carrier, an image-forming means by which an electrostatic latent image is formed on the image carrier and reproduced as a toner image, which is then transferred from the image carrier to a sheet medium, and a fuser unit for heat-fixing the toner image on the sheet medium, while the sheet medium is conveyed along a path provided through the apparatus, the image carrier being incorporated in a process cartridge together with at least one element in the image-forming means, wherein a housing for accommodating the elements of the apparatus is a clam-shell type composed of a lower frame and an upper frame hinged to the lower frame at the rear end thereof, so that an opening is formed between both frames when the upper frame is separated from the lower frame, through which opening the process cartridge is inserted and removed from the housing.

According to the another aspect of the present invention, an image-forming apparatus is provided which includes an image carrier, an image-forming means by which an electrostatic latent image is formed on the image carrier and reproduced as a toner image, which is then transferred from the image carrier to a sheet medium, and a fuser unit for heat-fixing the toner image on the sheet medium, while the sheet medium is conveyed along a path provided through the apparatus, the image carrier being incorporated in a process cartridge together with at least one element in the image-forming mean, wherein a housing for accommodating the elements of the apparatus is a clam-shell type composed of a lower frame and an upper frame hinged to the lower frame at the rear end thereof, wherein the process cartridge and a motor for driving all of the rollers required for conveying the sheet medium are positioned in the lower frame, and the rollers for conveying the sheet medium are positioned in the upper frame, whereby the conveying path can be completely separated from the surface of the image carrier and thus the rollers become freely rotatable.

Preferably, the process cartridge is fixed in place in the lower frame by a positioning mechanism. Preferably, the image carrier is a photoconductive drum. Further, advantageously the process cartridge includes in addition to the photoconductive drum, a precharger, a developer and a cleaner. Also advantageously, the developer includes a toner vessel, in which a powdery toner is filled, an agitator and a magnetic roller.

These and other objects and advantages of the present invention will be more apparent from the following description with reference to the drawings illustrating the preferred embodiments of the present invention.

DETAILED DESCRIPTION OF THE PREFERRED EMBODIMENTS

The structure of a printer according to the present invention is explained in detail with reference to FIGS. 3 through 21.

Figure 6:
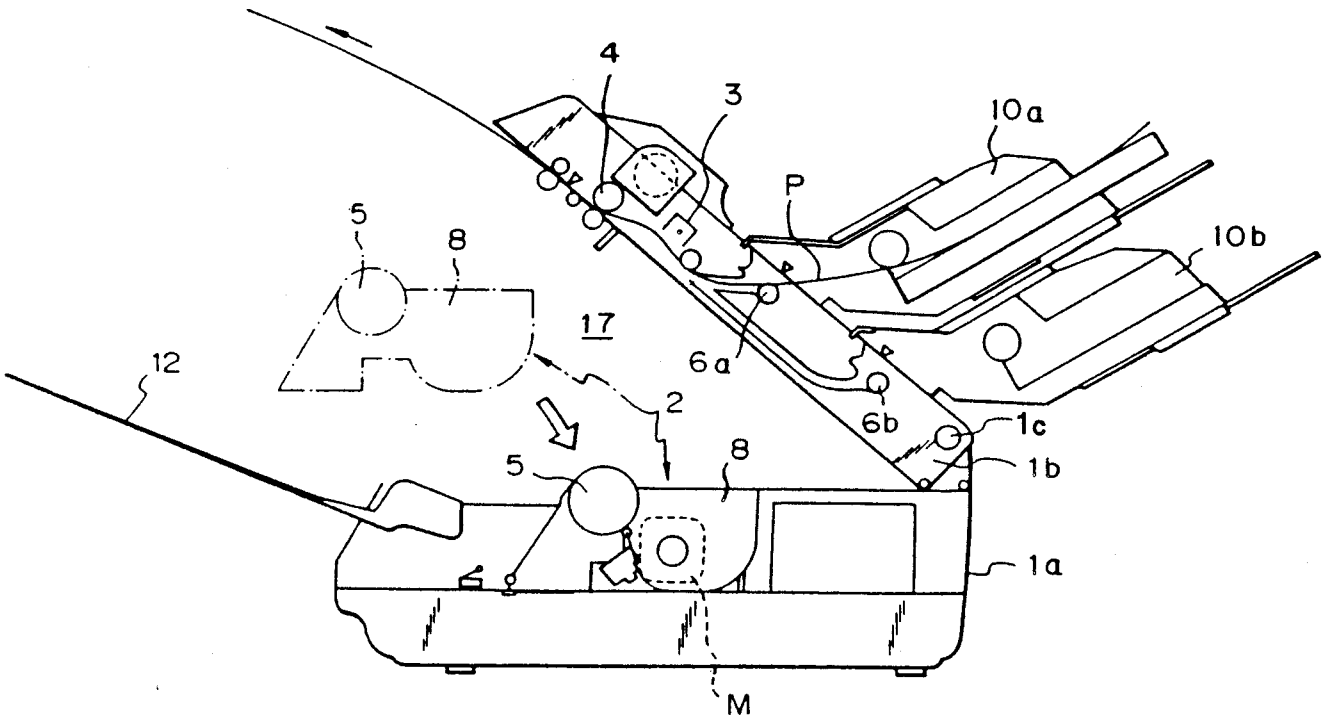
FIG. 6 is a schematic side view of the printer corresponding to FIG. 4.

The printer comprises a clam-shell type housing 1 having an upper frame lb and a lower frame la detachably connected to each other by a pin 1*c*, as shown in FIG. 6. In the drawings, reference numeral 62 designates a control panel for controlling the operation of the printer and 12 designates a stacker for receiving a printed medium 25 (cut sheets).

Figure 5:
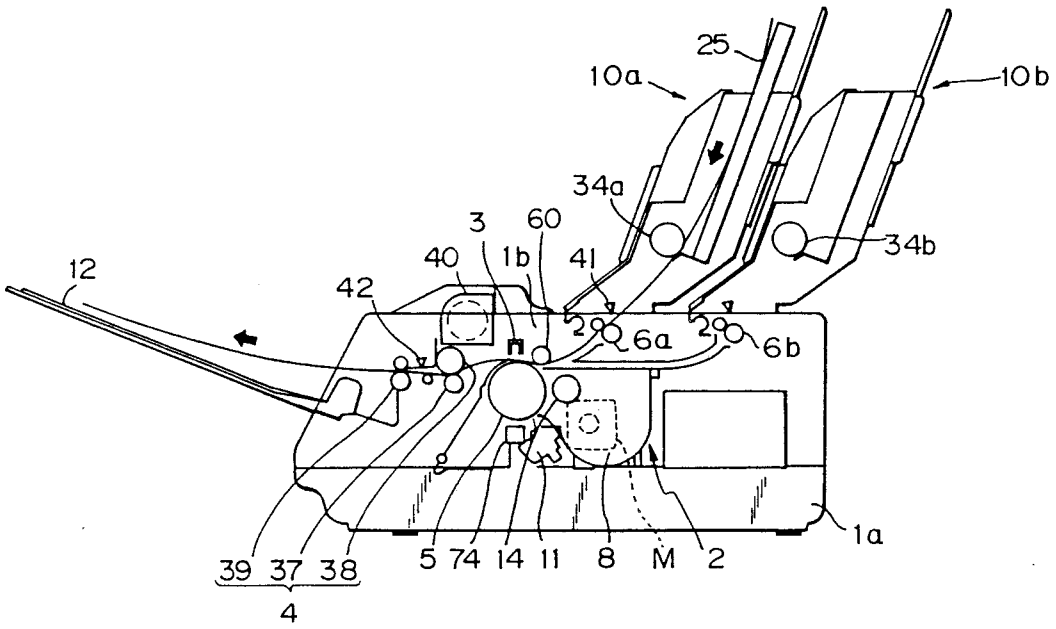
FIG. 5 is a schematic side view of the printer corresponding to FIG. 3.
Figure 9:
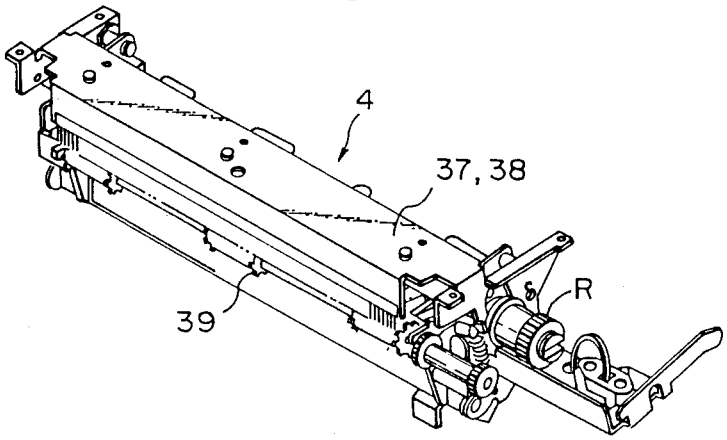
FIG. 9 is a perspective view of a fuser unit.

As apparent from FIG. 5, the upper frame lb has a fuser unit 4, a cooling fan 40, an entry sensor 41, an exit sensor 42 and a transfer-charger 3. In addition, first and second hoppers 10*a* and 10*b* are detachably secured to the upper frame lb. The hoppers 10*a* and 10*b* are provided, respectively, with pickup rollers 34*a*, 34*b*, which correspond, respectively, to regist rollers 6*a*, 6*b* secured to the upper frame lb. Different kinds of cut sheets 25 can be accommodated in these hoppers, respectively. During the printing operation, either one of the hoppers is selected by the action of magnetic clutches 295*a*, 298*a*, as stated later. As shown in FIGS. 5 and 9, a heat roller 37, a backup roller 38, and an eject roller 39 are all incorporated into the fuser unit 4.

Figure 4:
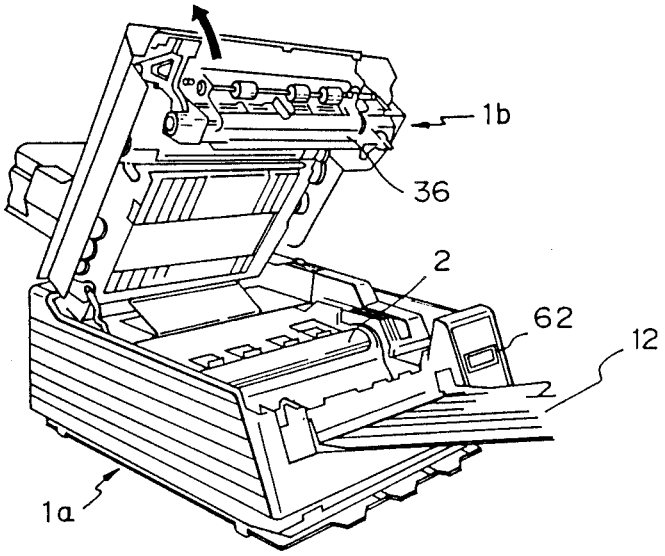
FIG. 4 is a perspective view of a printer shown in FIG. 3, when the upper and lower frames are separated.
Figure 10:
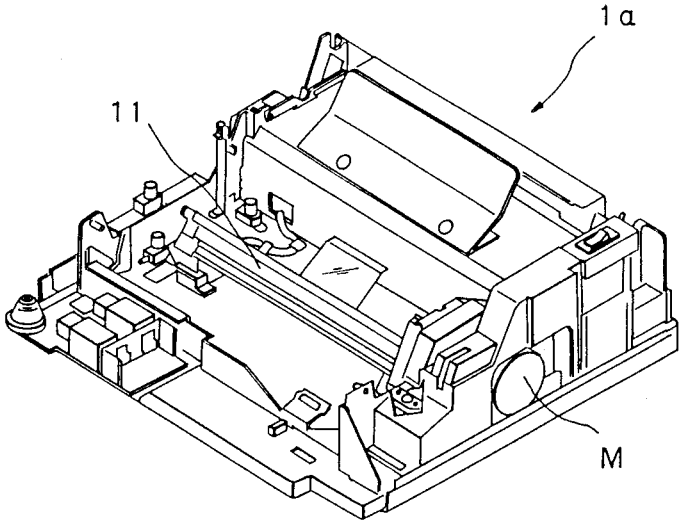
FIG. 10 is a perspective view of the lower frame.

As illustrated in FIGS. 4, 6 and 10, in the lower frame 1*a* are secured a process cartridge 2, an LED array 11, and a motor M, which is a drive source for the rotating elements of the printer.

Figure 7:
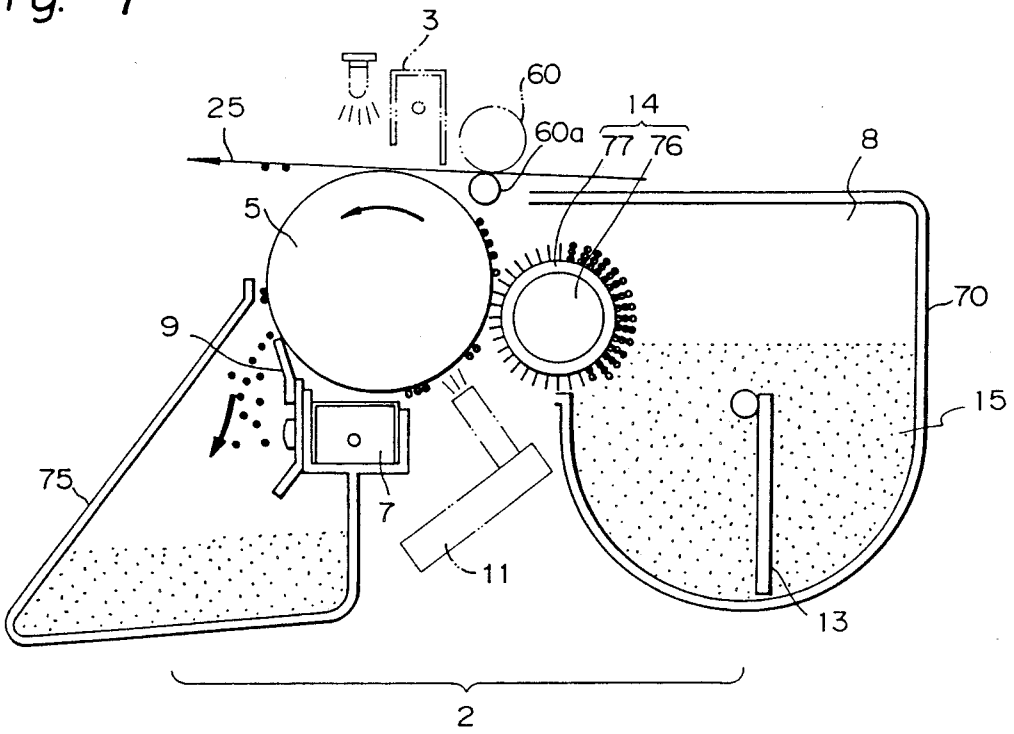
FIG. 7 is a schematic side view illustrating an internal structure of a process cartridge.
Figure 8:
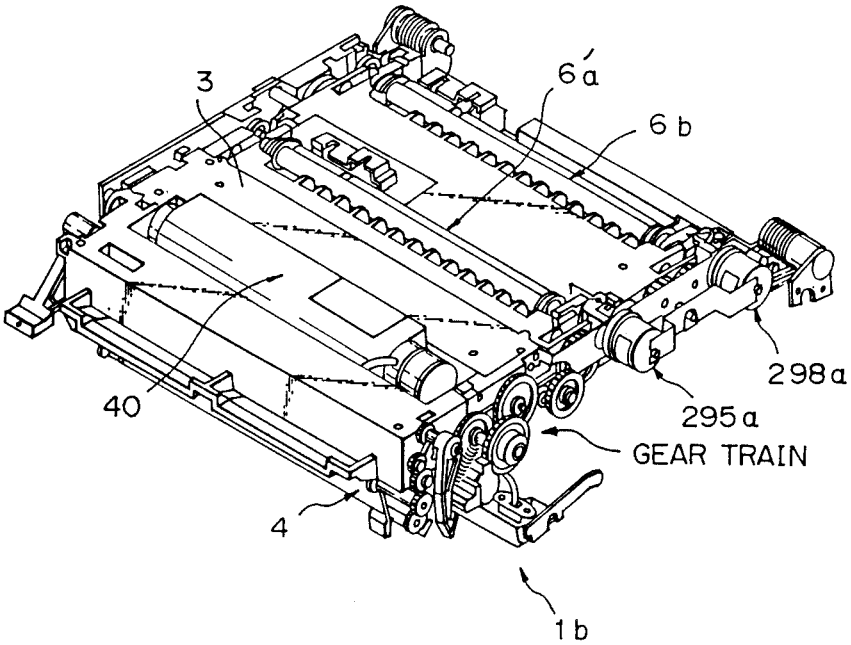
FIG. 8 is a perspective view of the upper frame.
Figure 11:
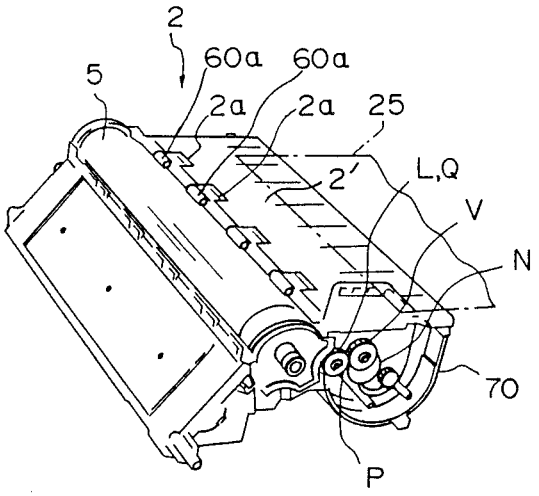
FIGS. 11(a) and 11(b) are perspective views, respectively, of a process cartridge.
Figure 11:
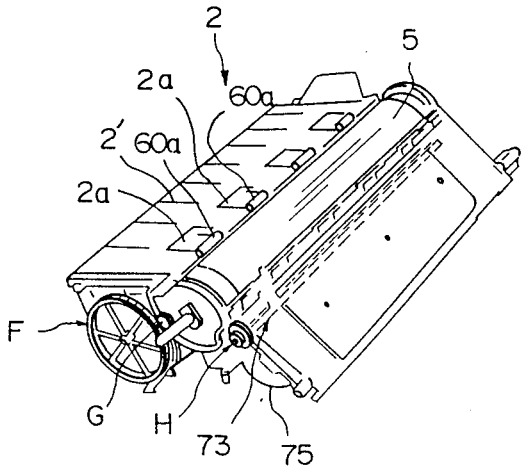

With reference to FIGS. 7, and 11, the process cartridge 2 is a composite body in which a developer unit 8 consisting of a toner vessel 70, an agitator 13, and a magnetic roller 14; precharger 7; a cleaner 9; a residual toner withdrawal vessel 75; and a photoconductive drum 5, are integrally and compactly combined. The cartridge 2 is easily attached to and detached from the lower frame la by a mechanism described later. In the developer unit 8, a toner powder 15 in the vessel 70 is stirred by the agitator 13 and uniformly fed to the magnetic roller 14. The magnetic roller 14 includes of a magnetic core 76 covered by a sleeve 77. The magnetic core 76 and the sleeve 77 rotate, respectively, at different speeds, so that the sleeve 77 can convey a toner powder onto the surface of the photoconductive drum 5 by a magnetic brush formed on the surface of the sleeve 77, which toner powder forms a toner image on the drum 5 corresponding to a latent image. The cleaner 9 is adapted to clean residual toner powder from the surface of the photoconductive drum 5 after the toner is transferred to the cut sheets 25. The precharger 7 is adapted to uniformly impart an electric charge to the surface of the photoconductive drum 5, to prepare for the next image forming cycle. An upper surface 2' of the process cartridge 2 constitutes a guide plate for the cut sheets 25. A pinch roller 60*a* is provided at a front edge of the upper surface 2' and biased upwardly by a blade spring 52*a* to be resiliently in contact with a guide roller 60 secured on the upper frame 1*b*. The cut sheet 25 can be introduced into an image-transfer zone formed between the drum 5 and a transfer-charger 3, while nipped between the pinch roller 60*a* and the guide roller 60.

Torque from the motor M is transmitted to the respective rotating elements in the lower frame la and the upper frame lb through a gear box secured on one side of the lower frame.

Figure 12:
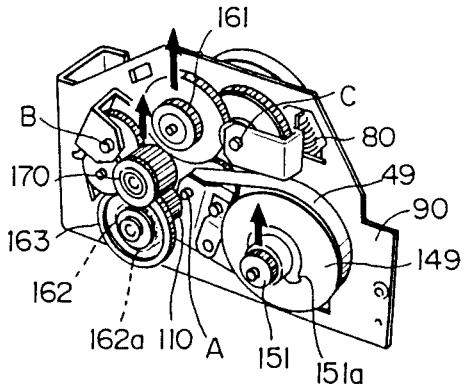
FIG. 12 is a perspective view of a gear box provided in the lower frame.

FIG. 12 shows the gear box with the cover removed therefrom, in which various gears and pulleys are secured on a bracket 90. Torque from the motor M is transmitted to a gear 162 from a motor gear 110. A gear 163 is coaxially secured with the gear 162, with the intention of a known spring type one-way clutch 162*a*, so that only the counter-clockwise rotation of the gear 162 can be transmitted to the gear 163. Also, a one-way clutch 151*a* of the same type as the clutch 162*a* is disposed between a pulley 149 and a gear 151 secured coaxially therewith, and transmits only the counter-clockwise rotation of the pulley 149 to the gear 151.

In FIG. 12, the gear 151 is used for driving the photoconductive drum 5 in the process cartridge 2 and is biased about a shaft A in the arrowed direction by a spring (not shown). A gear 170 is used for driving the magnetic roller 14 and is biased about a shaft B in the arrowed direction. Further, a gear 161 is used for transmitting torque to a gear train for driving the rollers secured in the upper frame 1*b* and is biased about a shaft C by a spring 80. These three gears 151, 170, and 161 are key gears for outputting torque from the gear box.

Figure 13:
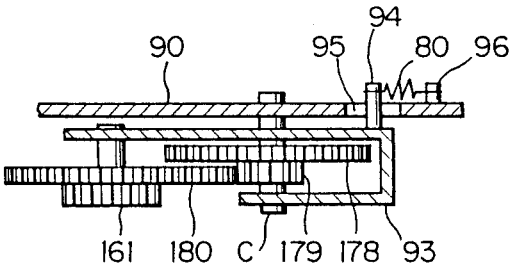
FIG. 13(a) is a plan view of a mechanism ensuring an intermeshing of a gear in the gear box with a gear in the upper frame.
FIG. 13(b) is a partial enlarged back view of the mechanism of FIG. 13(a)
Figure 13B:
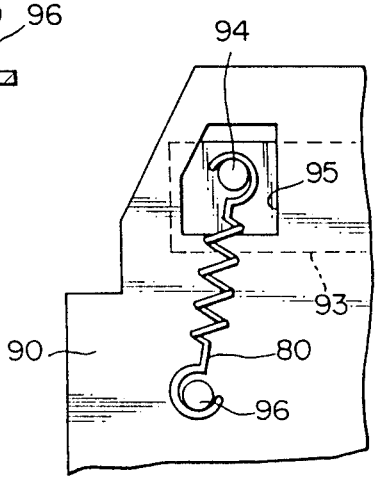

The above mechanism for biasing these gears is described in more detail with reference to FIGS. 13(a) and 13(*b*), referring to the gear 161 as an example. Gears 161, 180 fixed coaxially with each other are rotatably secured at one end of a U-shaped member 93. The member 93, in turn, is rotatably secured at a middle portion thereof on the shaft C of a gear 179 intermeshed with the gear 180. The shaft C is rotatably secured on the bracket 90. At the other end of the member 93 opposite to the gear 161 is provided a pin 94, which extends backward through an aperture 95 of the bracket 90. The spring 80 (also see FIG. 13(*b*)) is hooked at one end thereof to the pin 94 and at the other end thereof to another pin 96 fixed on a lower portion of the bracket 90. According to this mechanism, the gear 161 is always resiliently biased in the arrowed direction in FIG. 12. Similar mechanisms are provided for the gears 151 and 170, and accordingly, these key wheels are firmly intermeshed with the corresponding external gear when the latter is meshed with the former.

Next, an operation of the gear box will be explained below.

Figure 14A:
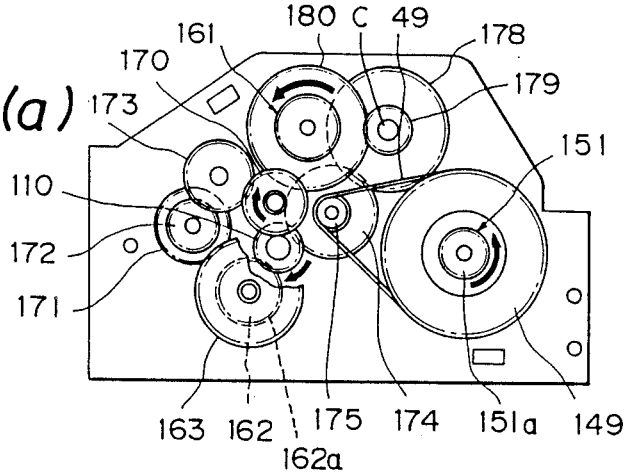
FIGS. 14(a) and 14(b) are side views of the gear box, illustrating a path of torque transmission according to the rotational direction of a motor, respectively.
Figure 14B:
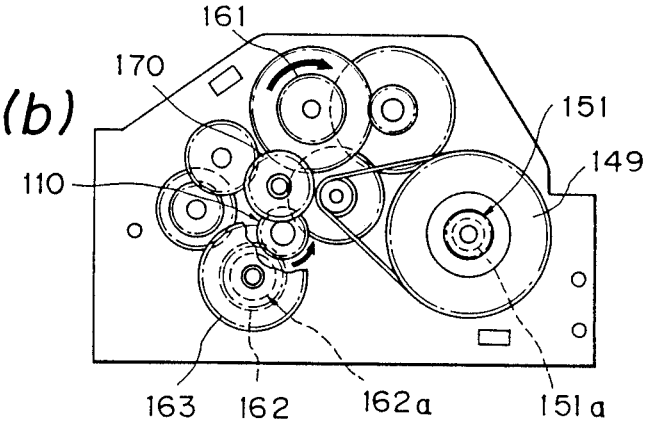

When the motor M rotates clockwise, as shown in FIG. 14(*a*), torque is transmitted by the motor gear 110 to the gear 162, which is then driven counter-clockwise. This rotation is transmitted to the gear 163 by the one-way clutch 162*a* , and sequentially, through a gear train 171, 172, and 173, to the gear 170, which is then driven in the arrowed direction. The rotation of the motor gear 110 also drives the gear 161 in the arrowed direction through a gear train 174, 178, 179, 180, and drives the gear 151 in the arrowed direction through a path of the gear 174, a pulley 175, a belt 49, and the pulley 149. Note, a pulley/belt mechanism is used for driving the gear 151 so that the photoconductive drum 5 can be smoothly rotated, resulting in a better printing quality.

When the motor M is rotated counter-clockwise, as shown in FIG. 14(*b*), the gear 162 is driven clockwise and the torque is not transmitted to the gear 163 by the one-way clutch 162*a*. Therefore, the gear 170 downstream of the gear 163 remains stationary. Nevertheless, the rotation of the motor gear 110 is transmitted to the gear 161 through the gear train 174, 178, 179, 180 and drives the same in the arrowed direction (reverse to the case shown in FIG. 14(*a*)). Note, although the pulley 149 is driven in the reverse direction (clockwise) through the aforesaid path, this rotation is not transmitted by the one-way clutch 151*a* to the gear 151, which thus remains stationary. Accordingly, the rotating elements in the process cartridge 2 can be driven only when the motor is rotated clockwise, and are not driven when the motor is rotated counter-clockwise. A mechanism for driving the process cartridge 2 is explained in more detail with reference to FIGS. 7, 11 and 15.

Figure 15A:
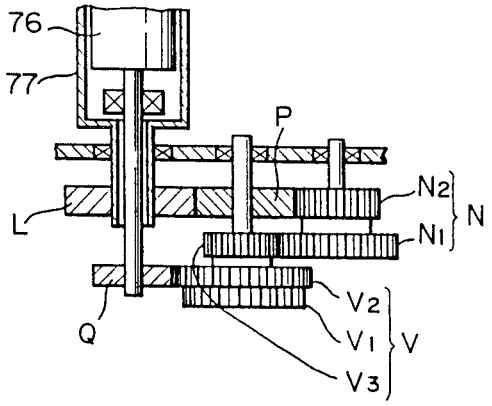
FIG. 15(a) is a plan view of a gear mechanism for driving rotating elements in the process cartridge.
Figure 15B:
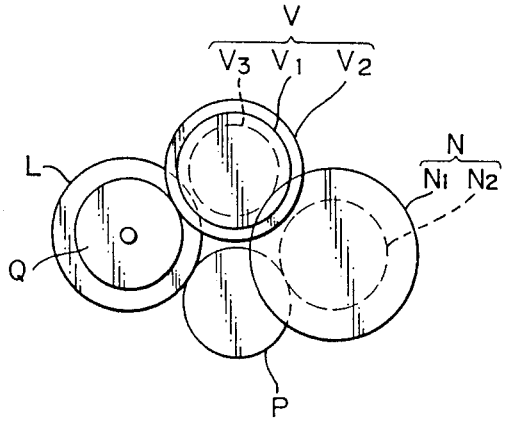
FIG. 15(b) is a side view of the gear mechanism of FIG. 17(a)

The details of gears L through Q for driving the process cartridge 2 are shown in FIGS. 15(*a*) and 15(*b*); these gears are also illustrated in FIG. 11(*a*) in a simplified manner. A gear L is fixedly secured at one end of the sleeve 77, and a gear Q is fixedly secured at one end of the magnetic roller 76. A gear V consists of three gears V1, V2, V3 coaxially and integrally fixed to each other and a gear N consists of two gears N1 and N2 also coaxially and integrally fixed to each other. The gear V1 is intermeshed with the gear 170 in the gear box and transmits the rotation thereof through the gear V2 to the gear Q, which then drives the magnetic core 76. The rotation of the gear V2 is transmitted through a gear train V3, N1, N2, P to the gear L, which then drives the sleeve 77. The gears V, N, P are rotatably secured on a side wall of the process cartridge 2. With reference to FIG. 11(*b*), a gear G fixed at the opposite end of the magnetic core 76 is intermeshed with a gear F fixed at one end of a shaft of the agitator 13, to drive the latter.

Next, a description will be given of a gear train arranged in the upper frame 1*b*.

Figure 16:
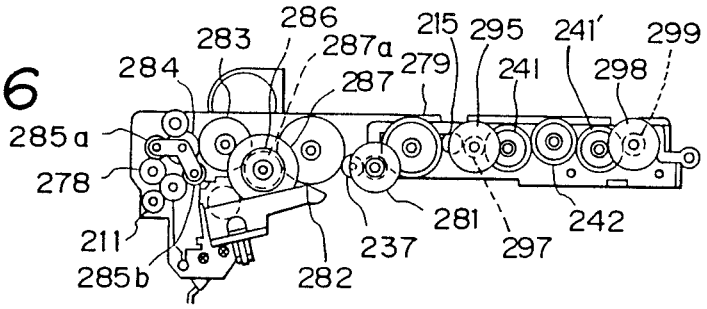
FIG. 16 is a side view of a gear train provided on one side of the upper frame.

With reference to FIG. 16, a gear 281 disposed at a center of the gear train is intermeshed with the gear 161 in the gear box of the lower frame 1*a*.

First, in a path from the gear 161 to the left in FIG. 16, torque is transmitted through a gear train 237, 282, 286 to a gear 287, which is intermeshed with a gear R (FIG. 9) fixed on a shaft of the heat roller 37 of the fuser unit 4, to drive the same. In this connection, the gears 286 and 287 are secured coaxially with a one-way clutch 287*a* disposed therebetween, which is adapted to transmit only the clockwise rotation of the gear 286 to the gear 287. Accordingly, the heat roller 37 can rotate only counter-clockwise, to move the cut sheets 25 forward.

Figure 17B:
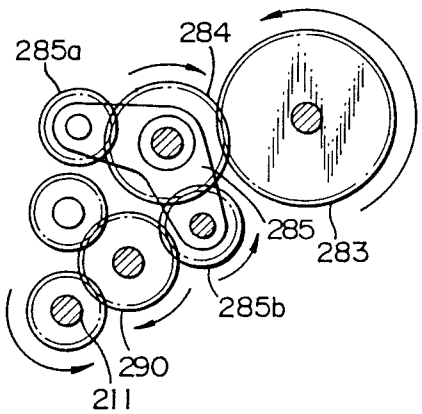
FIGS. 17(*a*) and 17(*b*) are enlarged views, respectively, of part of the gear train of FIG. 16, illustrating a transmission path for driving an eject roller.
Figure 17A:
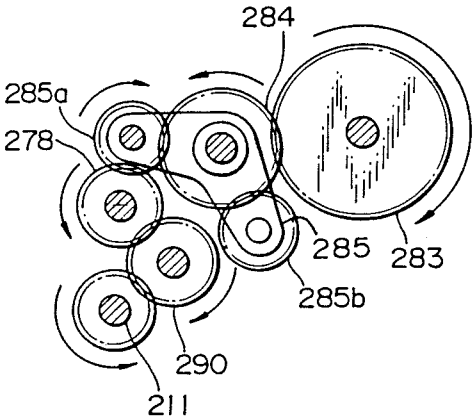

The gear 286 further transmits torque to a gear 211 for driving the eject roller 39 through a gear train 283, 284, 285*a* or 285*b*, and 278. As shown on an enlarged scale in FIGS. 17(*a*) and 17(*b*), the gear 285*a* is secured at one end of an L-shaped lever 285 which, in turn, is pivoted about an axis X coaxially with the gear 284. At the other end of the lever 285 is secured a gear 285*b* having the same number of teeth as the gear 285*a*. As shown in FIG. 17(*a*), when the gear 283 is rotated clockwise, the gear 284 is driven counter-clockwise and the lever 285 also pivoted in the same direction, whereby the gear 285*a* is intermeshed with the gear 278 while the other gear 285*b* is free. Consequently, the gear 211 is driven counter-clockwise as shown by an arrow, which corresponds to the running direction of the cut sheets 25. Conversely, as shown in FIG. 17(*b*), when the gear 283 is rotated counter-clockwise, the lever 285 is pivoted clockwise so that the gear 285*b* intermeshed with the gear 290, whereby the gear 211 is still driven counter-clockwise, which is the same direction as before. Namely, the eject roller 39 is always made to rotate in one direction even though the rotation of the gear 281 is reversed.

The guide roller 60 is made to rotate by the gear 237.

Figure 18:
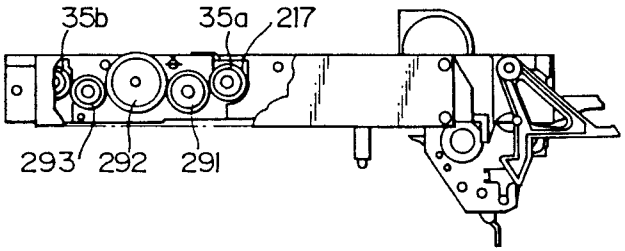
FIG. 18 is a side view of a gear train provided on the other side of the upper frame.
Figure 19:
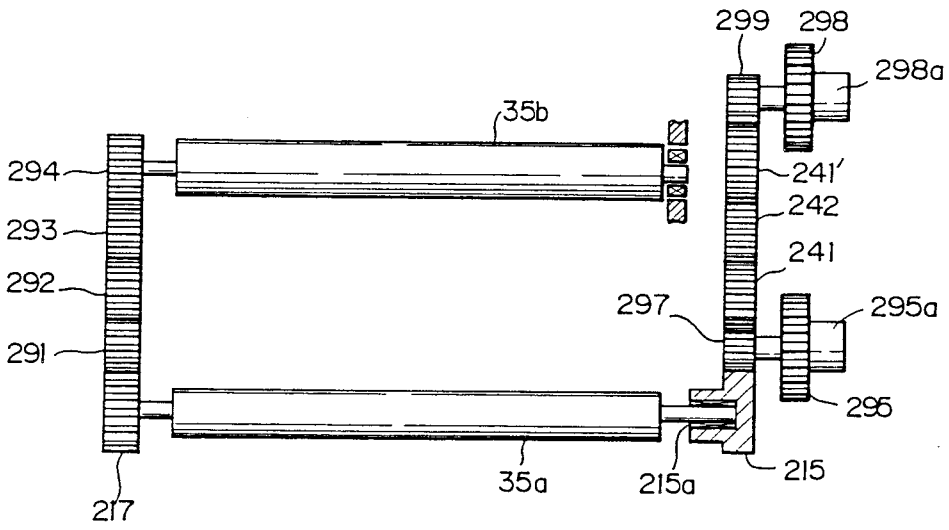
FIG. 19 is a plan view illustrating a gear train for driving a regist roller and a pickup roller.

Next, a transmission path to the right in FIG. 16 will be explained with reference to FIGS. 16, 18, and 19. Torque from the motor M is transmitted to a gear 215 secured at one end of a shaft of the regist roller 6*a* for the first hopper 10*a* via a one-way clutch 215*a*. The one-way clutch 215*a* is adapted to prevent a rotation of the gear 215 in the direction for driving the pickup roller 11 from being transmitted to the regist roller 6*a* but to permit the transmission of the opposite rotation of the gear 215 to the regist roller 6*a* to transport the cut sheets 25. At the opposite end of the regist roller 6*a* is fixed a gear 217, which is associated with a gear 294 fixed at one end of the regist roller 6*b* for the second hopper 10*b* via a gear train 291, 292 and 293. In this structure, both the regist rollers 6*a*, 6*b* are made to rotate simultaneously with each other. A press roller (not shown) for nipping the cut sheets in association with the regist roller 6*a*, 6*b* is provided adjacent to the respective regist rollers 6*a*, 6*b* and is made to rotate by the latter through a gear-engagement therewith.

Figure 20:
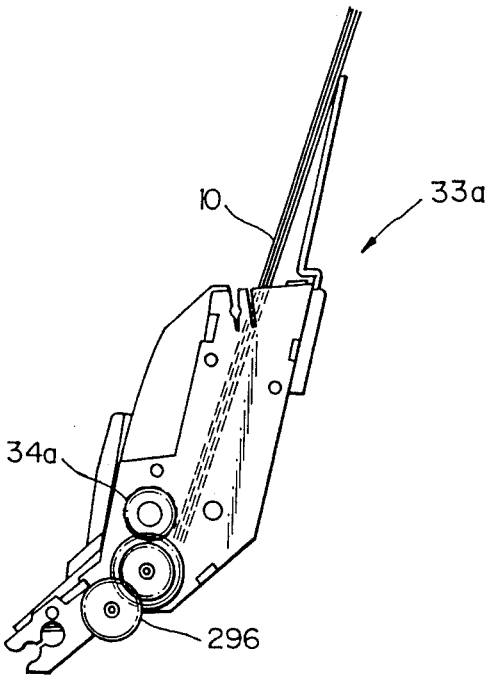
FIG. 20 is a side elevational view of a hopper illustrating a gear secured to and driving the pickup roller.

The gear 215 is also intermeshed with a gear 297 coaxially fixed with a gear 295 having a magnetic clutch 295a and is associated with a gear 299 coaxially fixed with a gear 298 having a magnetic clutch 298a. The gear 295 is provided for engagement with a hopper gear 296 in the first hopper 10a, as shown in FIG. 20, and transmits the rotation to the latter when the magnetic clutch 295a is actuated so that the pickup roller 34a is made to rotate. In a similar manner, the pickup roller 34b in the second hopper 10b is driven when the magnetic clutch 298a is actuated.

Figure 21A:
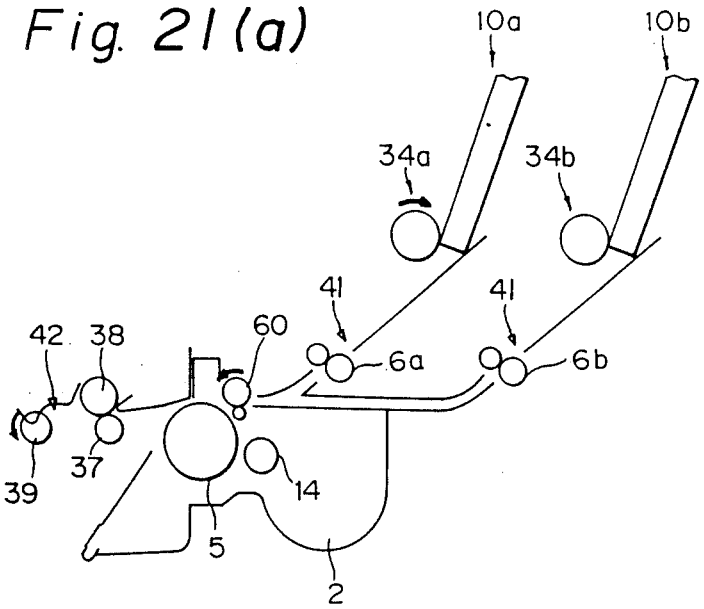
FIGS. 21(a) and 21(b) are schematic side views, respectively, illustrating the rotational direction of the respective elements in the printer.
Figure 21B:
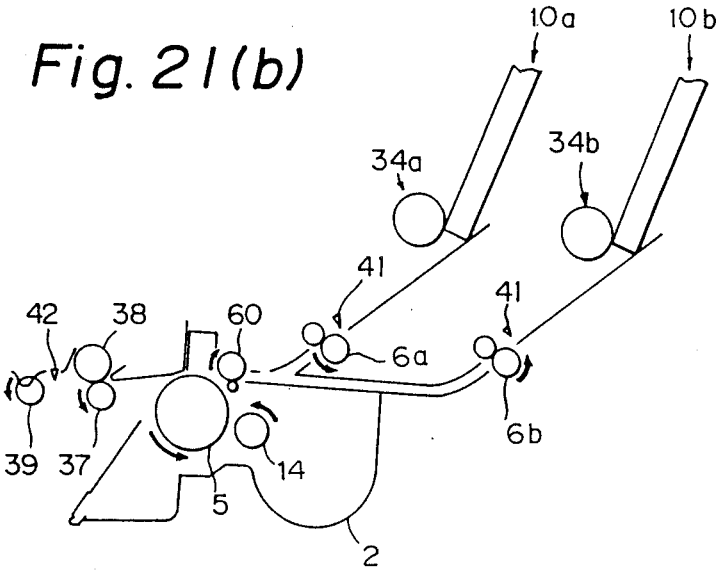

Upon starting the operation of the above-described printer, the selection of the hopper must be made first by actuating one of the magnetic clutches. If the hopper 10a is selected, the magnetic clutch 295a is actuated so that the transmission path to the hopper 10a is formed. Note, the other magnetic clutch 298a is not activated. Then the motor M is made to rotate in the direction whereby the pickup roller 34a is driven to move the cut sheets 25 forward, as shown in FIG. 21(*a*). When the front edge of the cut sheet 25 is detected by the entry sensor 41, the magnet clutch 295a is made off and then the motor M is stopped. When the next command is output, the motor M is rotated in the opposite direction, whereby the rotating elements in the printer other than pickup rollers 34a, 34b are driven in the arrowed direction in FIG. 21(*b*). The cut sheet 25 passes the upper surface of the photoconductive drum 5, and when the rear edge of the cut sheet 25 is detected by the exit sensor 42, the motor is stopped and waits for the command to commence the next printing.

In this connection, although the guide roller 60 rotates with the pickup roller 34a in the reverse direction to the normal operation, as shown in FIG. 21(*a*), this causes no problem because no cut sheets are present in the operation zone of the guide roller 60 at this stage. Further, when the regist roller corresponding to the selected hopper is driven, the other regist roller is rotated therewith, as shown in FIG. 21(*b*), which also causes no problem because the cut sheet 25 is not engaged with the other regist roller at this stage.

Figure 1:
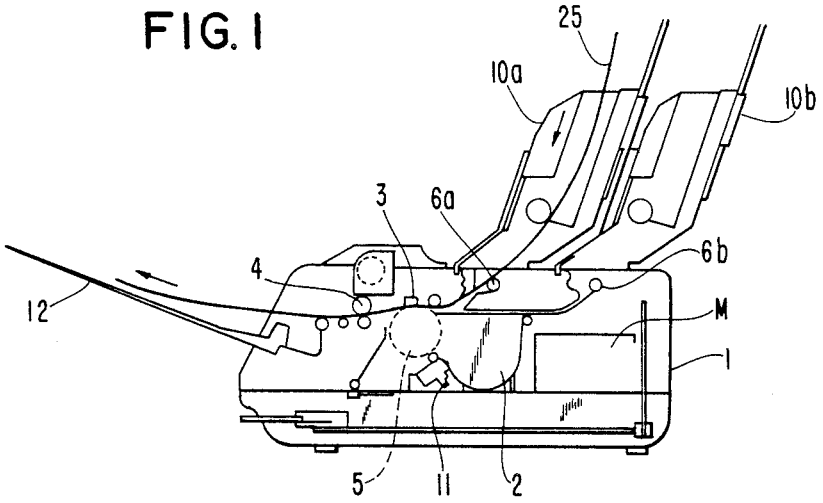
FIG. 1 is a schematic side view of an electrographic printer illustrating a general structure thereof.
Figure 1A:
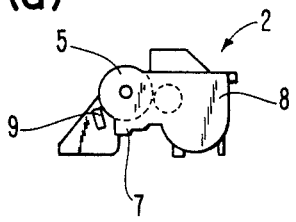
Figure 2:
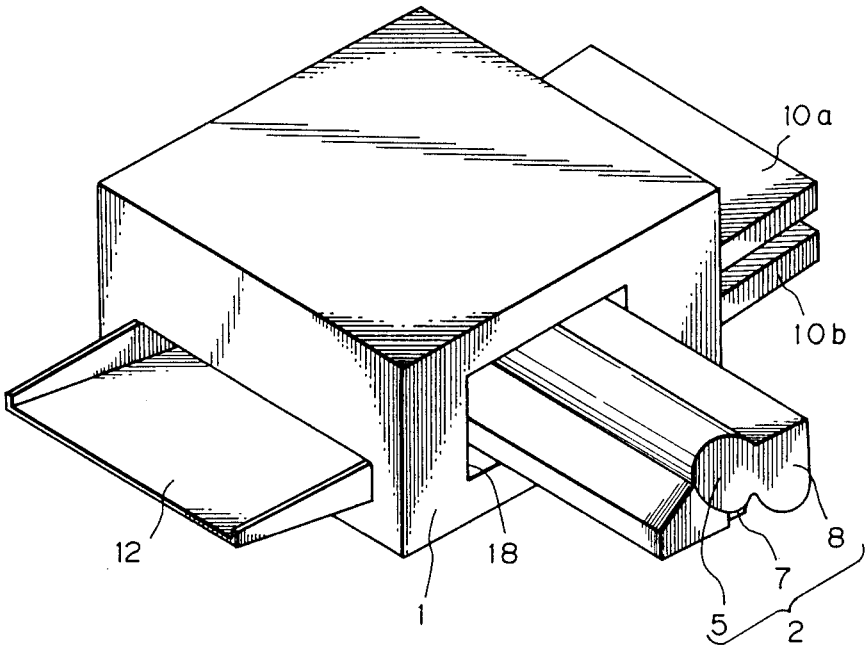
FIG. 2 is a perspective view illustrating the replacement of a process cartridge in a typical prior art printer.
Figure 3:
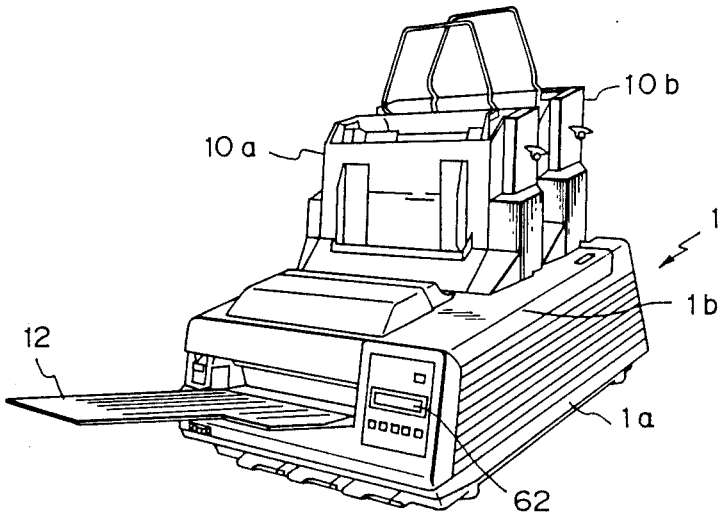
FIG. 3 is a perspective view of a printer according to the present invention, when the upper and lower frames are fitted together.

As described above, according to the printer of the present invention, the housing 1 is split into lower and upper frames 1a, 1b, pivotably hinged together at one end thereof by a pin 1e. Therefore, as shown in FIG. 6, the process cartridge 2 can be easily inserted into or removed from the interior of the housing 1 through an opening formed between the lower and upper frames 1a, 1b. This eliminates the need for a space outside of the side wall of the housing 1 for lateral movement of the process cartridge 2, the prior art shown in FIG. 2.

Figure 22:
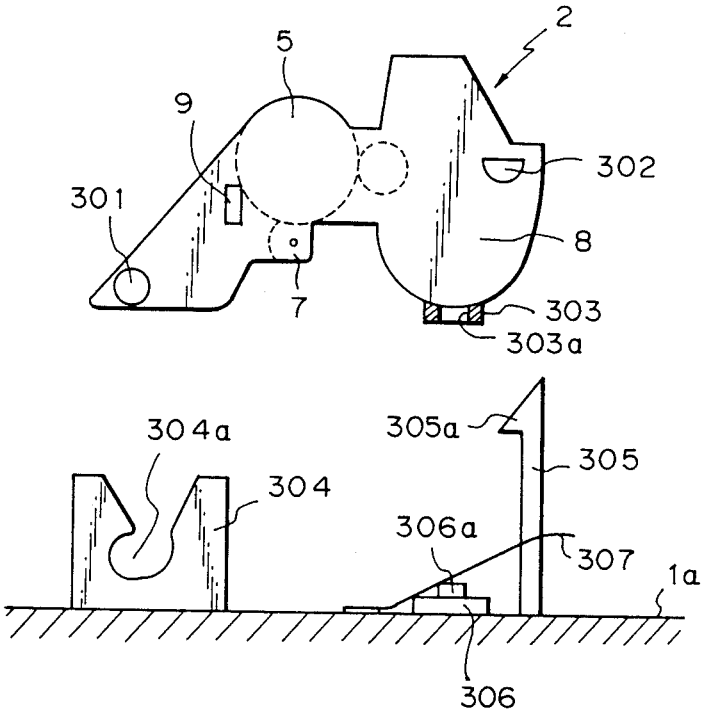
FIG. 22 is a side view of the respective elements of a positioning mechanism for a process cartridge when the cartridge is outside of the printer housing.
Figure 23:
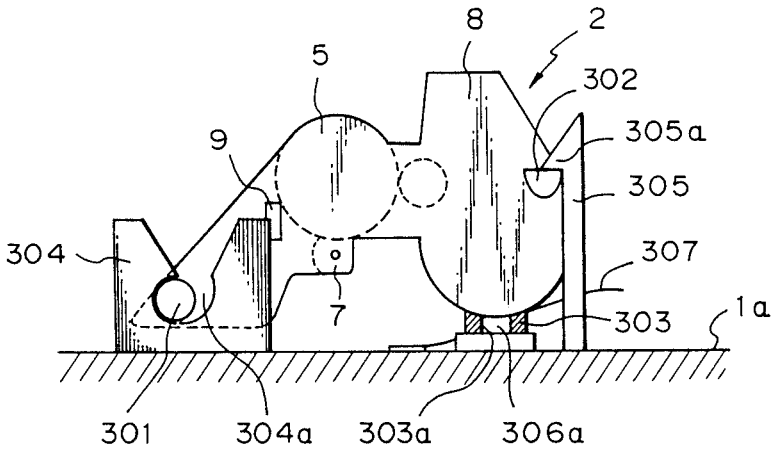
FIG. 23 is a view similar to FIG. 22 but showing the cartridge positioned in the printer housing.

Next, a mechanism for easily positioning and detachably locking the process cartridge 2 in the lower frame 1a is described with reference to FIGS. 22 and 23.

The process cartridge 2 has projections 301, 302, and 303 for the positioning thereof, each of which is provided in pairs on the respective side of the process cartridge 2. The projection 303 has a recess 303a.

On the bottom wall of the lower frame la are provided members 304, 305, and 306 corresponding to the projections 301, 302, and 303, respectively. As shown in FIG. 22, the member 304 is a vertical plate having a cavity 304a specially shaped to receive the projection 301. The member 305 is a resiliently deformable vertical pillar and has a hook 305a for engagement with the projection 302. The member 306 is a seat having an upright strut 306a thereon.

A blade spring 307 is secured on the lower frame 1a between the pair of members 306, to lift up the process cartridge 2.

When the process cartridge 2 is inserted into the interior of the lower frame 1a, first the projection 301 is fitted to the cavity 304a, and then the projection 302 comes into contact with the hook 305a, by which the member 305 is resiliently deformed backward by the downward displacement of the process cartridge 2. Accordingly, the recess 303a is fitted to the strut 306a, whereby the horizontal displacement of the process cartridge 2 is limited. As the process cartridge 2 is pushed up by the spring 307, the projection 302 abuts against the hook 305a to limit the displacement of the process cartridge 2 in the up-down direction.

Namely, the process cartridge 2 is fixed in place in the lower frame; i.e., the photoconductive drum 5 is accurately positioned relative to the image-forming means and the transfer-charger.

When the exhausted cartridge is removed to be replaced by a fresh cartridge, the cartridge 2 to be removed is pushed toward the pillar member 305 to disengage the projection 301 from the cavity 304a, and then the cartridge 2 is lifted up while releasing the projection 302 from the hook 305a.

Other and further effects of the present invention are as follows:

1. When the upper frame 1b is separated from the lower frame la in a clam-shell manner, the motor M and the process cartridge 2 including the photoconductive drum 5 remain in the lower frame 1a, while the pre-charger 3, the fuser unit 4 and the rollers 6a, 6b accommodated in the upper frame 1b are lifted upward. That is, the upper and lower frames 1a, 1b are separated from each other along a sheet conveying path thereof. This structure is particularly useful when a paper jam occurs, because the rollers 6a, 6b for conveying the cut sheet 25 are completely disengaged from the motor M and are thus freely rotatable, so that the operator can manually rotate the rollers in either direction to remove the jammed sheet.

2. The photoconductive drum 5 is positioned in the lower frame 1a and the transfer-charger 3 is positioned in the upper frame 1b, and the cut sheet 25 runs therebetween. Accordingly, the toner image is transferred from the photoconductive drum 5 to the lower surface of the cut sheet 25, and thus the cut sheet 25 is sequentially discharged to the stacker 12 in a face-down manner.

We claim:

1. An image-forming apparatus comprising:

an image carrier, image-forming means for forming an electrostatic latent image on the image carrier and reproducing the same as a toner image, which is then transferred from the image carrier to a sheet medium, a fuser unit for heat-fixing the toner image on the sheet medium, while the sheet medium is conveyed along a path provided through a apparatus, the image carrier being incorporated in the process cartridge together with at least one element in the image-forming means, and a housing for accommodating the image-forming means, the fuser unit and the image carrier and having a lower frame and an upper frame hinged to the lower frame at the rear end thereof, the process cartridge and a motor for driving all rollers for conveying the sheet medium being positioned in the lower frame, and the rollers for conveying the sheet medium being positioned in the upper frame so that, when the upper frame is separated from the lower frame, the conveying path is completely separated from the surface of the image carrier and thus the rollers are freely rotatable, and the process cartridge is inserted to and removed from the housing through an opening formed between both frames.

2. An image-forming apparatus as claimed in claim 1, wherein the process cartridge is fixed in place in the lower frame by a positioning mechanism.

3. An image-forming apparatus as claimed in claim 1, wherein the image carrier is a photoconductive drum.

4. An image-forming apparatus as claimed in claim 3, wherein the process cartridge comprises, in addition to the photoconductive drum, a precharger, a developer and a cleaner.

5. An image-forming apparatus as claimed in claim 4, wherein the developer comprises a toner vessel, in which a powdery toner is filled, an agitator and a magnetic roller.

6. An image-forming apparatus as defined in claim 2, characterized in that the image carrier is a photoconductive drum.

7. An image-forming apparatus comprising:

an image carrier, image-forming means for forming an electrostatic latent image on the image carrier and reproduced as a toner image, which is then transferred from the image carrier to a sheet medium, a fuser unit for heat-fixing the toner image on the sheet medium, while the sheet medium is conveyed along a path provided through the apparatus, the image carrier being incorporated in a process cartridge together with at least one element in the image-forming means, and a housing for accommodating the image-forming means, the fuser unit and the image carrier and having a lower frame and an upper frame hinged to the lower frame at the rear end thereof the process cartridge and a motor for driving all rollers for conveying the sheet medium being positioned in the lower frame, and the rollers for conveying the sheet medium being positioned in the upper frame so that the conveying path is completely separated from the surface of the image carrier and thus the rollers are freely rotatable.

8. An image-forming apparatus as defined in claim 7, characterized in that the process cartridge is fixed in place in the lower frame by a positioning mechanism.

9. An image-forming apparatus as defined in claim 7, characterized in that the image carrier is a photoconductive drum.

10. An image-forming apparatus comprising:

a housing having an upper frame and a lower frame pivotally connected at one end to the upper frame;

a fuser unit mounted in the upper frame and having a heat roller;

at least one hopper detachably connected to the upper frame and having a pick-up roller;

a regist roller corresponding to each at least one hopper and being disposed within the upper frame;

a process cartridge removably mounted in the lower frame and including a developer unit having a photoconductive drum;

a transfer-charger mounted in the upper frame in proximity to the photoconductive drum;

at least one guide roller mounted in the upper frame;

a drive motor, disposed in the lower frame, for driving the various rollers and the photoconductive drum; and a transmission having a first portion disposed in the upper frame and being operatively connected to the various rollers of the upper frame, and a second portion disposed in the lower frame coupled to the motor and disconnectable from the first portion when the upper and lower frames are pivoted relative to each other.

11. An image-forming apparatus as claimed in claim 6, wherein the first portion of the transmission is a gear train coupling the various rollers mounted in the upper frame to each other, and the second portion of the transmission includes a fist gear biased into engagement with the gear train, and being separable from the gear train when the upper and lower frames are pivoted relative to each other.

12. An image-forming apparatus as claimed in claim 10, wherein the motor is operable in first and second directions, and the second portion of the transmission includes second and third gears operatively coupled through clutch means to the photoconductive drum and a magnetic roller of the process cartridge so as to limit movement of the photoconductive drum and magnetic roller in one direction.

13. An image-forming apparatus as claimed in claim 10, wherein the gear train includes a heat roller gear and a clutch disposed between the heat roller gear and the heat roller for limiting directional movement of the heat roller in one direction.

14. An image-forming apparatus as claimed in claim 6, further comprising means for positioning the process cartridge in the lower frame.

15. An image-forming apparatus as claimed in claim 13, wherein the positioning means includes a bracket connected to the lower frame and having a receptacle opening upwardly, radially outwardly extending protrusions formed on one end of the process cartridge and being receivable in the receptacle of the bracket thus providing a pivotal connection between the process cartridge and the lower frame, a complimentary, interfitting mount disposed between the lower frame and a bottom portion of the process cartridge, and a snap-fitting connection between the opposite end of the process cartridge and lower frame.

16. An image-forming apparatus as claimed in claim 14, further comprising spring means disposed between the process cartridge and the lower frame for biasing the process cartridge upwardly.

17. An image-forming apparatus comprising:

a housing having an upper frame and a lower frame pivotally connected at one end to the upper frame;

a fuser unit mounted in the housing and having a heat roller;

at least one hopper detachably connected to the housing;

a pick-up roller for picking up a sheet medium from the hopper;

a process cartridge removably mounted in the lower frame and having an image carrier;

a transfer means mounted in the upper frame in proximity to the image carrier;

a drive motor, disposed in the lower frame, for driving the pick-up roller and the image carrier; and a transmission having a first portion disposed in the upper frame and operatively connected to the pick-up roller connected to the upper frame, and a second portion disposed in the lower frame coupled to the motor and disconnectable from the first portion when the upper and lower frames are pivoted relative to each other.

* * * * *